US005471538A

United States Patent [19]

Sasaki et al.

[11] Patent Number: 5,471,538

[45] Date of Patent: Nov. 28, 1995

[54] MICROPHONE APPARATUS

[75] Inventors: Tooru Sasaki, Tokyo; Kaoru Gyotoku, Kanagawa, both of Japan

[73] Assignee: Sony Corporation, Tokyo, Japan

[21] Appl. No.: 57,821

[22] Filed: May 7, 1993

[30] Foreign Application Priority Data

May 8, 1992 [JP] Japan ..... 4-143209

[51] Int. Cl.[6] ..... H04R 3/00

[52] U.S. Cl. ..... 381/92; 381/94

[58] Field of Search ..... 381/92, 94

[56] References Cited

U.S. PATENT DOCUMENTS

| | | | |
|---|---|---|---|
| 4,370,523 | 1/1983 | Bäder | 381/92 |
| 4,589,137 | 5/1986 | Miller | 381/92 |
| 4,741,038 | 4/1988 | Elko et al. | 381/92 |
| 4,802,227 | 1/1989 | Elko et al. | 381/92 |
| 4,888,807 | 12/1989 | Reichel | 381/92 |
| 5,033,082 | 7/1991 | Eriksson et al. | 381/94 |
| 5,243,661 | 9/1993 | Ohkubo et al. | 381/94 |

FOREIGN PATENT DOCUMENTS

| | | |
|---|---|---|
| 0084982 | 8/1983 | European Pat. Off. . |
| 0381498 | 8/1990 | European Pat. Off. . |
| 60097729 | 5/1985 | Japan . |
| 9204781 | 3/1992 | WIPO . |

*Primary Examiner*—Forester W. Isen
*Attorney, Agent, or Firm*—Jay H. Maioli

[57] ABSTRACT

A microphone apparatus having a first microphone for picking up a desired sound and a second microphone with directionality in which sensitivity is low to the desired sound arrival direction. A sound signal from the second microphone is supplied to a subtracting circuit through an adaptive filter. The subtracting circuit subtracts an output signal of the adaptive filter from the sound signal coming from the first microphone. A circuit is provided to adjust the adaptive filter so that the output power of the subtracting circuit is minimized. The setup implements a microphone system which is compact in size and easily provides desired directionality.

6 Claims, 7 Drawing Sheets

MICROPHONE APPARATUS

BACKGROUND OF THE INVENTION

1. Field of the Invention

The present invention relates to a microphone apparatus.

2. Description of the Related Art

With a so-called camcorder, a lightweight television camera with an incorporated video cassette recorder, for example, sound around an object is recorded while the object is being pictured. In recording the sound, the microphone is designed so that only the sound coming from the direction of the object is recorded. That is, the camcorder is provided with a directional microphone that picks up the sound coming into the front of the camcorder.

One example of a microphone apparatus of this type is known as a "gun microphone." This microphone is provided, as shown in FIG. 1, with a pipe 2 extending from a diaphragm 1. The pipe 2 is provided with many through-holes 3 in its side wall, providing directionality so that the microphone is highly sensitive to a sound coming from its front and long along the center line of the pipe 2, or the opposite side of the diaphragm 1.

To be more specific, as shown in FIG. 1A, acoustic waves coming from the front of the microphone (the right-hand in the figure) have the same path length to the diaphragm 1 whether they arrive at it from the top of the pipe 2 or any one through-hole 3, so that they arrive in the same phase to be added together.

In contrast, as shown in FIG. 1B, acoustic waves coming from a side of the pipe 2 through different through-holes 3 differ in phase because their path lengths from the through-holes, or incident positions, to the diaphragm 1 are different. Likewise, as shown in FIG. 1C, an acoustic wave coming from the backside of the microphone arrives via different through-holes 3 at the diaphragm 1, causing a phase difference in the acoustic wave, or an incident signal. A plurality of holes 3 in the pipe 2 are arranged so that incident acoustic signals weaken each other. The microphone shown in FIG. 1 has a directionality in which sensitivity is low to acoustic waves coming from the side or back of the pipe.

Thus, the gun microphone as shown in FIG. 1 provides a directional microphone having a high sensitivity to an acoustic wave coming from the front of the microphone.

However, as described above, this microphone requires a pipe 2, which is long, thereby increasing the microphone's external dimensions.

Additionally, this unidirectional microphone has a high sensitivity only to acoustic waves coming from the front of the microphone, providing fixed, inflexible directionality. This makes it difficult to record not only sound coming from the desired direction of source, but also sound coming, for example, from the sides of the camcorder.

SUMMARY OF THE INVENTION

It is therefore an object of the present invention to provide a microphone apparatus which is compact in size and easily provides desired directionality.

In carrying out the invention and according to one aspect thereof, there is provided a microphone apparatus comprising a first microphone 11 (this and other reference characters below are identified in the accompanying drawings) for recording a desired sound, a second microphone having directionality in which sensitivity in the direction of the desired sound is low, an adaptive filter means 24 to which a sound signal is supplied from the second microphone, and a subtracting means 15 for subtracting an output signal of the adaptive filter means 24 from a sound signal of the first microphone 11, wherein the adaptive filter means 24 is adjusted to minimize an output power of the subtracting means 15.

If the directions in which sounds to be recorded come are different, it indicates that their sources are different and correlation between them is often low. In the above-mentioned novel constitution, directionality of the second microphone 21 is low in sensitivity in the direction of the desired sound. Therefore, correlation is low between a sound signal from the second microphone 21 and a sound signal from the first microphone 11. If the sound signal from the second microphone 21 is assumed to be noise, the microphone apparatus according to the invention has a constitution of an adaptive noise reduction system. In this system, when the output power of the subtracting means is minimized, the sound signal of the second microphone 21 is removed from the sound signal of the first microphone 11, providing only a desired sound from the first microphone 11 as an output sound signal. The adaptive noise reduction system is disclosed in U.S. Patent application Ser. No. 07/680,408 for example.

That is, the microphone apparatus according to an invention has the adaptive noise reduction system which makes a distinction between desired sound and noise depending on sound arrival direction wherein the directionality of the second microphone 21 is arranged to make the system mainly sensitive to the arrival direction of desired sound.

DESCRIPTION OF THE PREFERRED EMBODIMENTS

Figure 1A:
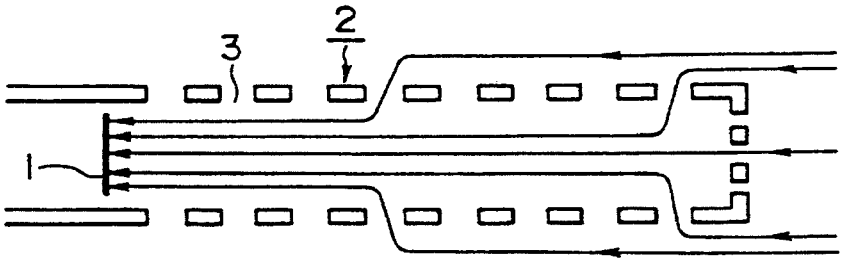
FIG. 1A PRIOR ART
FIGS. 1A–1C are a diagram illustrating an example of a prior-art microphone apparatus.
Figure 1B:
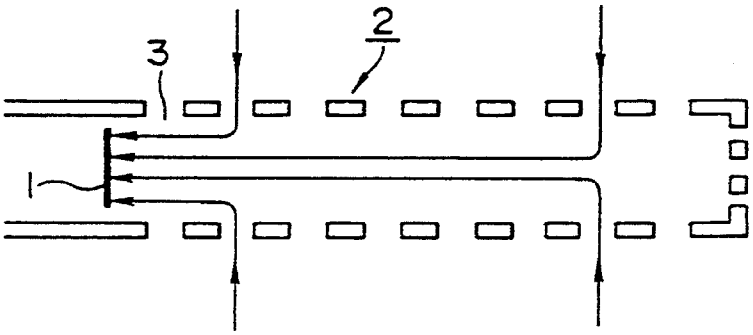
FIG. 1B PRIOR ART
Figure 1C:
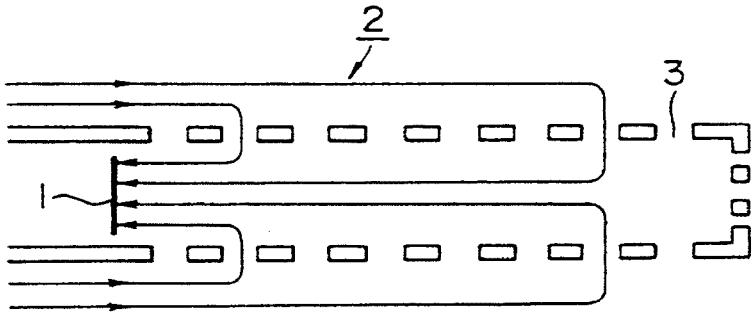
FIG. 1C PRIOR ART
Figure 2:
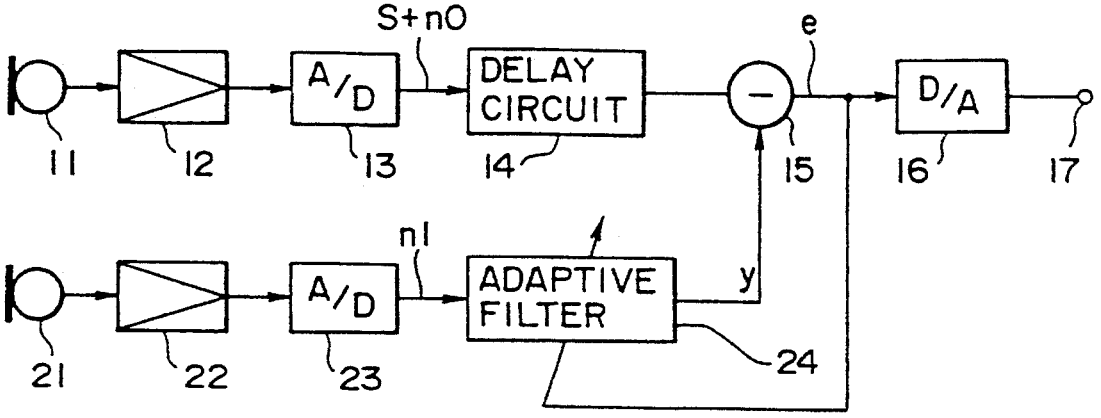
FIG. 2 is a block diagram of an embodiment of the microphone apparatus according to the invention.

For a general understanding of the features of the present invention, references are made to the embodiment of the microphone apparatus according to the invention as shown in FIG. 2.

Referring to FIG. 2, reference numeral 11 is a main input microphone for recording a desired sound and reference numeral 21 is a reference input microphone for picking up sound coming from a direction to be removed from the recording. In this example, the arrival direction of desired sound is mainly a direction indicated by an arrow AR in FIG. 3, or a direction from up to down (hereinafter referred to as the front direction). This setup is intended to implement a microphone apparatus which generally does not pick up any sound coming from a direction (hereinafter referred to as a rear direction) opposite to the front direction.

Figure 3:
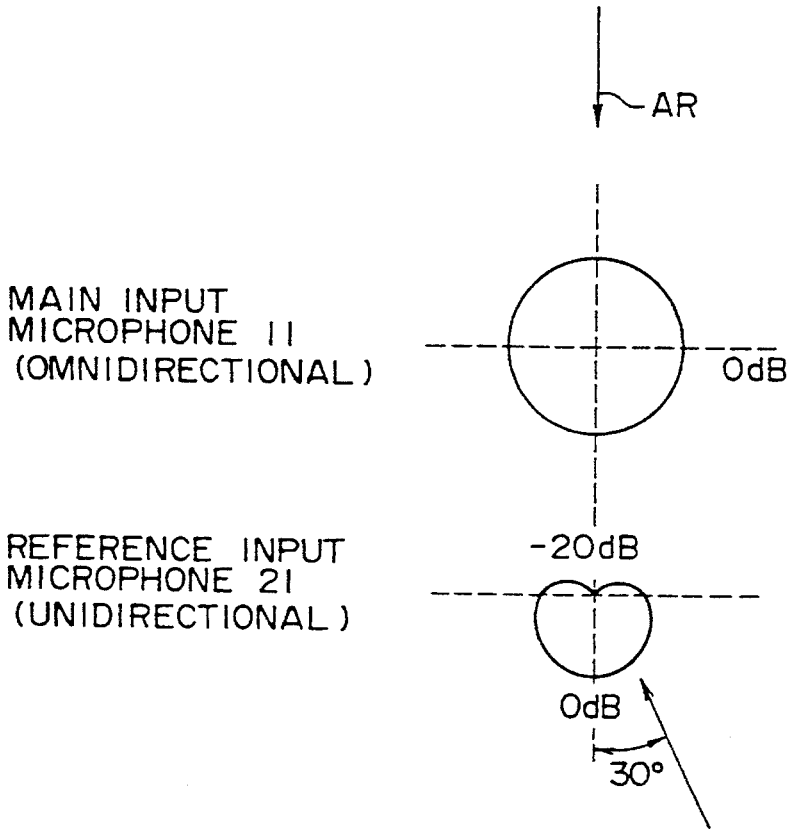
FIG. 3 is a diagram illustrating an example of directionalities of the first and second microphones.

In the above-mentioned example, the main input microphone 11 is constituted by an omnidirectional microphone as shown in FIG. 3, while the reference input microphone 21 is constituted by a unidirectional microphone which is mainly sensitive to the rear direction, not to the front direction or the desired sound arrival direction as shown in FIG. 3.

A sound signal picked up by the main input microphone 11 and converted into an electrical signal is fed to an A-D converter 13 through an amplifier 12 to be converted into a digital equivalent which is fed to a subtracting circuit 15 through a delay circuit 14.

A sound signal picked up by the reference microphone 21 and converted into an electrical signal is fed to an A-D converter 23 through an amplifier 22 to be converted into a digital equivalent which is fed to an adaptive filter circuit 24. The output signal of the adaptive filter circuit 24 is fed to the subtracting circuit 15. The output signal of the subtracting circuit 15 is fed back to the adaptive filter circuit 24 and, at the same time, converted into an analog signal by a D-A converter 16 to be fed to an output pin 17.

It should be noted that the sound signal may be output without passing it through the D-A converter 16, or the signal may be output in digital form. The delay circuit 14 is provided to compensate a time delay required by the adaptive filter circuit 24 for adaptive processing and a propagation time in the filter.

The adaptive filter circuit 24 controls so that a reference input sound signal approximates a sound signal other than that coming from the front direction included in a main input sound signal, as will become apparant. Consequently, if there is no correlation between a desired sound signal in the sound signal picked up by the main input microphone 11 and a sound signal other than that coming from the front direction, the sound signal picked up by the reference input microphone 21 is subtracted by the subtracting circuit 15 from the sound signal picked up by the main input microphone, making the subtracting circuit 15 put out only the desired sound signal.

In other words, the above-mentioned setup provides an adaptive noise reduction system to which the output sound signal of the main input microphone 11 is supplied as a main input and the output sound signal of the reference input microphone 21 is supplied as a reference input. This system operates as follows.

The main input sound signal from the A-D converter 13 is obtained by adding the desired sound signal s coming from the direction of arrow AR or the front direction to the sound signal n0 coming from the rear direction (hereinafter referred to as a noise) which is supposed to have no correlation with the main input sound signal. On the other hand, letting the reference input sound signal from the A-D converter 23 be n1, then, as seen from the above description, this reference input sound signal n1 has correlation with the noise n0, not with the desired sound signal. An adaptive processing algorithm makes the adaptive filter circuit 24 filter the reference input sound signal n1 to output a signal y and controls the adaptive filter circuit 24 so that a subtraction error e from the subtracting circuit 15 is minimized.

Here, suppose that s, n0, and n1 are statistically stationary and their average is 0, then an output is:

$$e=s+n0-y$$

Because there is no correlation between s and n0 and between s and y, an expected value obtained by squaring this result becomes as follows:

$$\begin{aligned} E[e^2] &= E[s^2]+E[(n0-y)^2]+2E[s(n0-y)] \\ &= E[s^2]+E[(n0-y)^2] \end{aligned}$$

The adaptive filter circuit 24 is adjusted to minimize E $[e^2]$. At this time, E $[s^2]$ is not affected;

Emin $[e^2]$=E $[s^2]$+Emin $[(n0-y)^2]$

That is, minimizing E $[e^2]$ in turn minimizes E $[(n0-y)^2]$, making the output y of the adaptive filter circuit 24 equal to an estimator of the noise n0. And an expected value of the output from the subtracting circuit 15 becomes only the desired signal. In other words, adjusting the adaptive filter circuit 24 to minimize a total output power is equal to making the subtracting output e be a least square estimator of the desired sound signal s.

Figure 4:
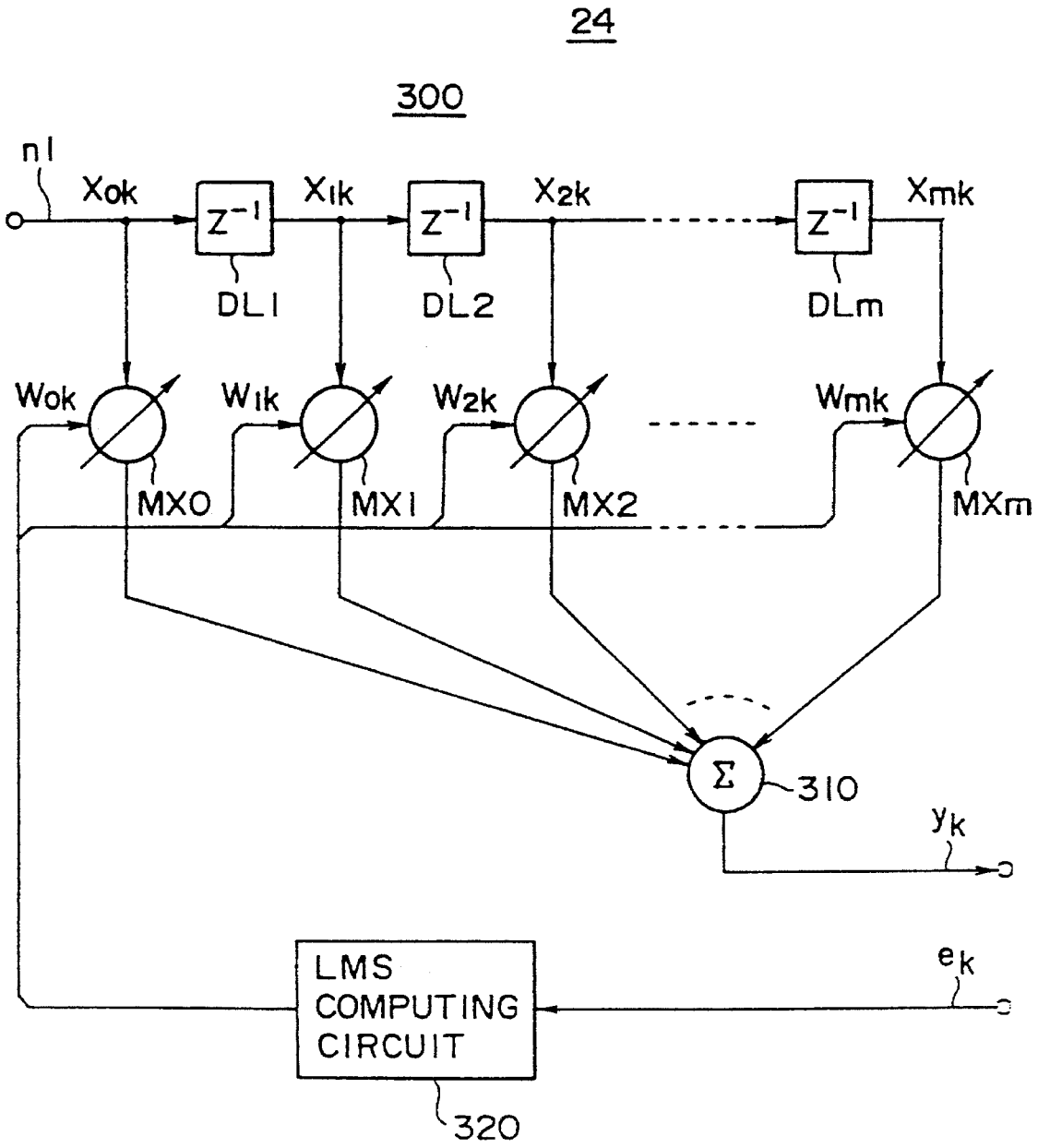
FIG. 4 is a diagram illustrating an example of an adaptive filter circuit of FIG. 2.

Referring to FIG. 4, one embodiment of the adaptive filter circuit 24 is exemplarily shown by using the algorithm of so-called LMS (Least Mean Square).

As shown in FIG. 4, an adaptive linear coupler 300 of FIR filter type is used in this example. This linear coupler comprises a plurality of delay circuits DL1, DL2, . . . DLm (m is a positive integer) respectively having a delay time $Z^{-1}$ of unit sampling time, multipliers MX0, MX1, . . . MXm for multiplying an output signal of each of the delay circuits DL1, DL2, . . . DLm by the input signal n1, and an adder 310 for adding outputs of the multipliers MX0 through MXm. An output of the adder 310 is equivalent to y shown in FIG. 2.

A weight to be supplied to the multipliers MX0 through MXm is formed based on the residual signal e coming from the subtracting circuit 15 in an LMS computing circuit consisting of a microcomputer for example. An algorithm to be executed in the LMS computing circuit 320 is as follows:

As shown in FIG. 4, let an input vector $X_k$ at time k be:

$$X_k 32\ [x_{0k}\ x_{1k}\ x_{2l} \ldots x_{mk}]^T$$

and an output be $y_k$ and the weight be $w_{jk}$ (j=0, 1, 2, . . . m), then a relation between input and output is an shown in equation (1).

$$y_k=\sum_{j=0}^{m} w_{jk}x_{jk} \tag{1}$$

If a weight vector $W_k$ at time k is defined as $$W_k=[w_{0k}\ w_{1k}\ w_{2k} \ldots w_{mk}]^T$$

then, the relation between input and output is given as $$Y_k=X_kT\cdot W_k$$

Let a desired response be $d_k$, then an error $e_k$ with the output is represented as follows:

$$e_k = d_k - y_k$$
$$= d_k - X_k^T \cdot W_k$$

With the LMS technique, the weight vector is updated by the following relation:

$$W_{k+1} = W_k + 2\mu \cdot e_k \cdot X_k$$

where, μ is a step gain for determining adaptivity speed and stability.

Thus, the sound signal mainly consisting of the desired sound signal, with the noise removed, appears on the output pin 17.

Meanwhile, to reduce the noise in the main input by using the reference input by means of the adaptive processing as described above, there should be no correlation between desired sound and reference noise as mentioned above. For this reason, conventional adaptive noise reduction systems of this type take such measures as preventing reception of a desired sound in a reference input by sound-proofing the reference input microphone or placing it as near a noise source as possible to separate it from a main input microphone. However, these measures make the systems large and inconvenient to move around.

In contrast, the present invention makes the distinction between desired sound and noise depending on the sound arrival direction. And it is so arranged that the main input microphone 11 has a directionality (including non-directionality) in which a sound coming from the desired sound arrival direction may be picked up and the reference input microphone 21 has a directionality in which there is no or little sensitivity in the desired sound arrival direction, thereby providing no correlation between the desired sound in the sound picked up by the main input microphone 11 and the noise picked up the reference input microphone 21.

Therefore, the present invention may only consider the directionalities of the main input microphone and the reference input microphone. This makes it possible to place both microphones in proximity, resulting in a compact implementation as compared with the conventional microphone systems.

The constitution according to the present invention adequately eliminates the noise signal from the main input, making it possible to easily implement a microphone system having directionality in which there is no or little sensitivity in the noise arrival direction. FIG. 5 illustrates an effect brought about by an experimental system based on this example.

To be specific, in the above-mentioned experimental system, the main input microphone 11 is placed in front of the reference input microphone 21, both placed along the desired sound arrival direction indicated by the arrow AR, as shown in FIG. 3. For a sound pickup operation, a sinusoidal-wave signal of 1 kHz for example is introduced in the arrow AR direction as a desired sound and a sinusoidal-wave signal of 600 Hz is introduced in a direction 30 degrees to the rear side as a noise.

In this example, sensitivity of the omnidirectional main input microphone is 0 dB and that of the reference input microphone 21 is –20 dB to a sound coming from the front side, 0 dB to a sound coming from the rear side, and –0.7 dB to a sound coming from a direction 30 degrees to the rear side.

Figure 5A:
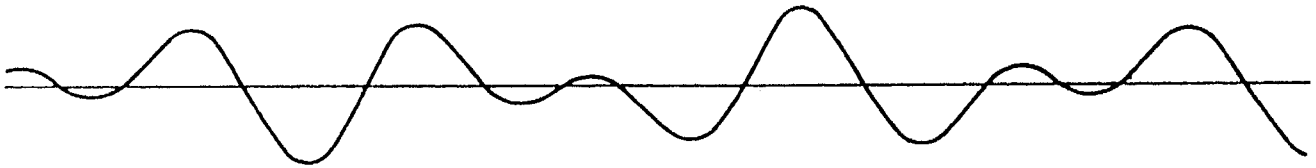
FIG. 5A–5C are diagram describing the operation of the microphone apparatus according to the invention.
Figure 5B:
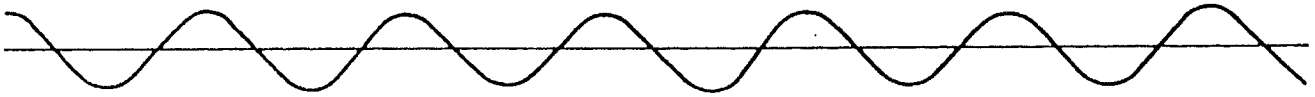
Figure 5C:
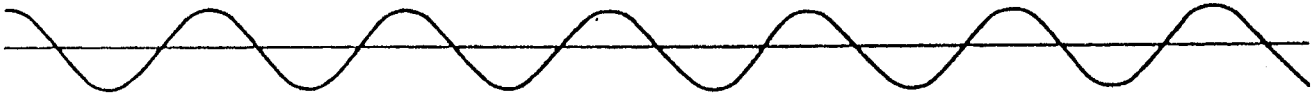

An input waveform on the main input microphone 11 is a composite of the 1 kHz and 600 Hz sinusoidal waves as shown in FIG. 5A. An output sound waveform appearing on the output pin 17 is as shown in FIG. 5B, which approximates an ideal output sinusoidal wave of 1 kHz as shown in FIG. 5C, proving the effect of the microphone apparatus according to the present invention.

Figure 6:
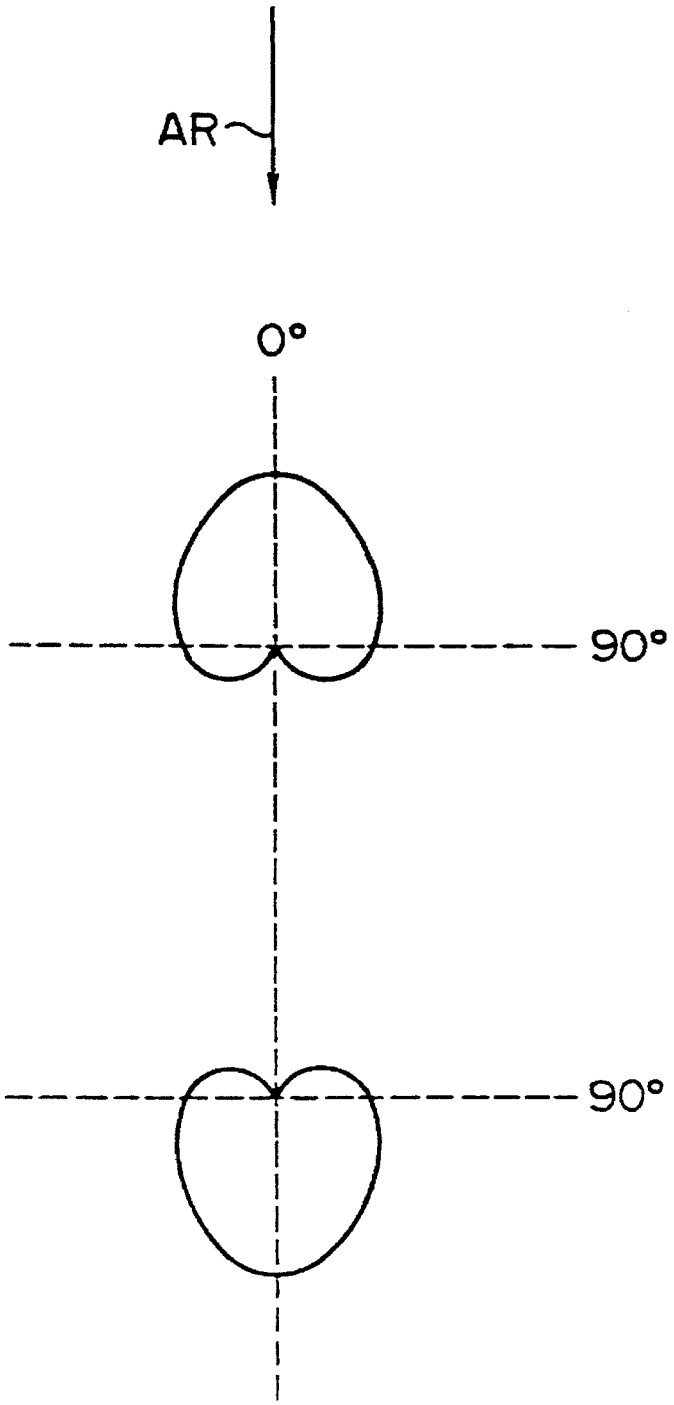
FIG. 6 is a diagram illustrating another example of the directionalities of the first and second microphones.
Figure 7:
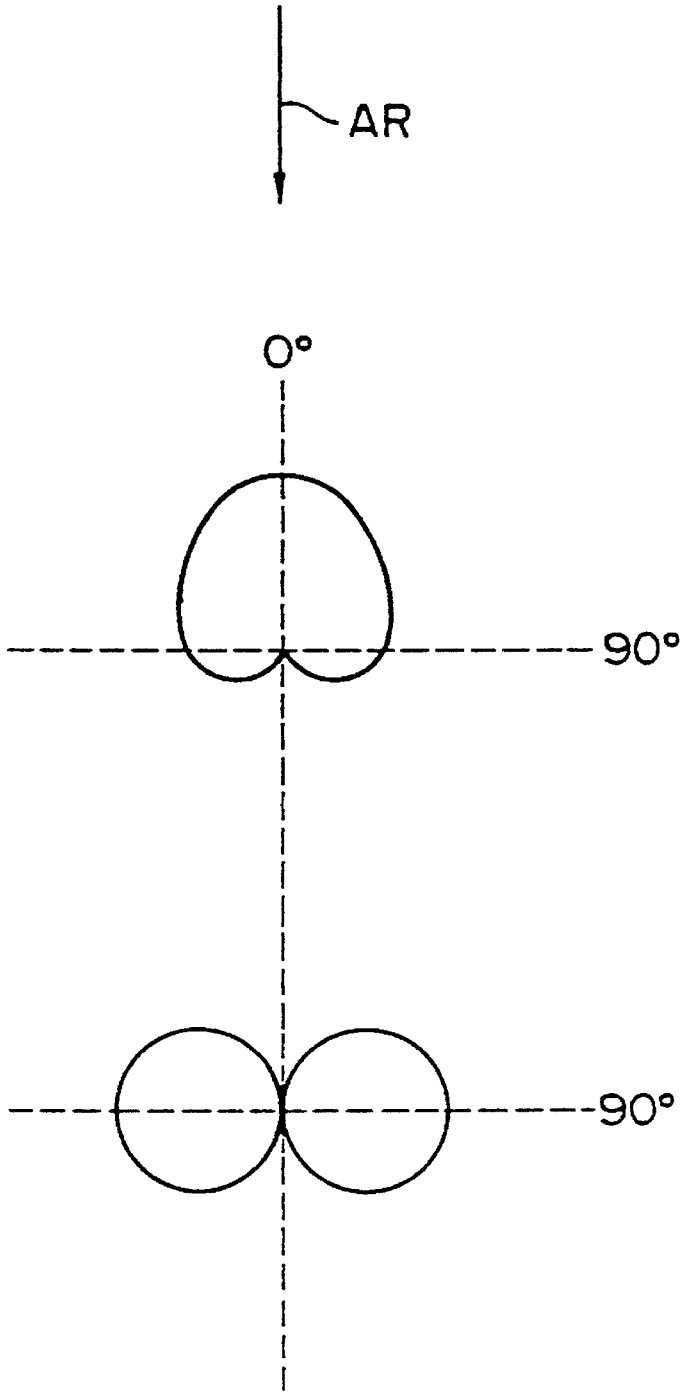
FIG. 7 is a diagram illustrating still another-example of the directionalities of the first and second microphones.

FIG. 6 and FIG. 7 respectively illustrate directional characteristics of the main input microphone 11 and the reference input microphone 21 of another embodiment of the present invention. In these examples, like the above-mentioned example, the main input microphone 11 is placed in front of the reference input microphone 21, both placed along the desired sound arrival direction indicated by the arrow AR.

In the example of FIG. 6, the main input microphone 11 is unidirectional and placed with its most sensible side in the front direction. The reference input microphone is also unidirectional and is placed with its most sensible side in the rear direction for example. In other words, the reference input microphone 21 has a low sensibility in the desired sound arrival direction and a high sensitivity in the rear direction or noise arrival direction.

Consequently, the example of FIG. 6 also may implement a microphone apparatus that outputs only a desired sound. In this example, if a noise signal arrives at an angle between the rear direction and about 90 degrees to it, a noise level in the main input becomes low because the sensitivity of the main input microphone 11 is low at that angle. Therefore, the main input microphone 11 itself contributes to noise reduction to some extent.

In the example of FIG. 7, the noise arrival direction is limited to around 90 degrees to the desired sound arrival direction and the sensitivity of the reference input microphone 21 is made high in a direction 90 degrees to the arrow AR direction. In this example, the reference input microphone 21 is bidirectional. As with the example of FIG. 6, the main input microphone 11 is unidirectional and is placed so that its sensitivity becomes highest in the desired sound arrival direction. The main input microphone 11 may also be non-directional in this example.

The above-mentioned examples use single microphone units having the discussed directional characteristics for the main input microphone 11 and the reference input microphone 21. For these microphones, a plurality of microphone units may also be used to implement respective microphones having desired directionality.

Implementation of a unidirectional microphone system by using two non-directional microphone units will be described as follows by referring to FIG. 8 and FIG. 9.

Figure 8:
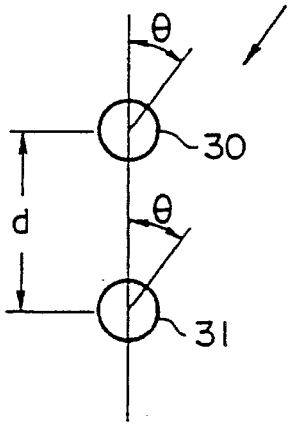
FIG. 8 is a diagram explaining an example of constituting the microphone with a plurality of microphone units.

Referring to FIG. 8, the non-directional microphone units 30 and 31 are spaced by a distance d. As shown in FIG. 9, an output sound signal of the microphone unit 30 is fed to a subtracting circuit 32 through an amplifier not shown. Likewise, an output sound signal of the microphone unit 31 is fed to the subtracting circuit 32 through an amplifier not shown and a filter 33. In this example, the filter 33 comprises a resistor 34 and a capacitor 35. Now, let resistance of the resistor 34 be R1 and capacity of the capacitor 35 be C1, then R1 and C1 are set so that a relation shown below is established:

$$C1 \cdot R1 = d/c$$

where c stands for acoustic velocity.

Then, in this example, an output of the subtracting circuit 32 is sent as an output sound signal to the output pin 37 through a frequency characteristic correcting circuit 36 such as an integrator for flattening the frequency characteristic of the signal. As will appear, this frequency characteristic correcting circuit 36 is provided as required.

The microphones in this example operate as follows. As shown in FIG. 8, let outputs of two microphone units 30 and 31 be P0 and P1 where a sound source is located at angle—to the direction in which the two microphone units are arranged and a sound arrives from the source at each microphone unit, then output P1 is:

$$P1=P0\epsilon-j\omega(d/c)\cos\theta$$

where—w is an angular frequency.

The output of the microphone unit 31 is fed to the subtracting circuit 32 through the filter 33, so that an output signal Pa of the subtracting circuit 32 is as given by equation (2):

$$\begin{aligned} Pa &= P0(1-A\epsilon^{-j\omega(d/c)\cos\theta}) \\ &\approx P0\{1-A+j\omega(d/c)\cos\theta\} \\ &= P0\cdot j\omega(d/c)\left(\frac{1-A}{j\omega d/c}+\cos\theta\right) \end{aligned} \quad (2)$$

In the equation (2), A indicates a filter function of the filter 33, and $j\omega\ d/c<<1$.

In the equation (2), if equation (3) below is satisfied, the output Pa is unidirectional:

$$1-A=j\omega d/c \quad (3)$$

$$A=1-j\omega d/c\approx\left(\frac{1}{1+j\omega d/c}\right)$$

That is, if the equation (3) is satisfied, the equation (2) becomes:

$$Pa=P0\cdot j\omega(d/c)(1+\cos\theta)$$

making the output Pa unidirectional to angle θ.

Meanwhile, in the above-mentioned example, the filter function A of the filter 33 is represented by $A=1/(1+j\omega Cl\cdot Rl)$ and is configured to be Cl·Rl)

and is configured to be Cl·Rl=d/c, so that $A=1/(1+j\omega d/c)$

Therefore, it is clear from the equation (3) that the microphone units in the embodiment of FIG. 8 are unidirectional, provided that, however, frequency characteristics of these microphone units are going upward to the right (that is, the higher the frequency, the greater the response). In this example, the frequency characteristic correcting circuit 36 is provided to flatten this characteristic.

Figure 9:
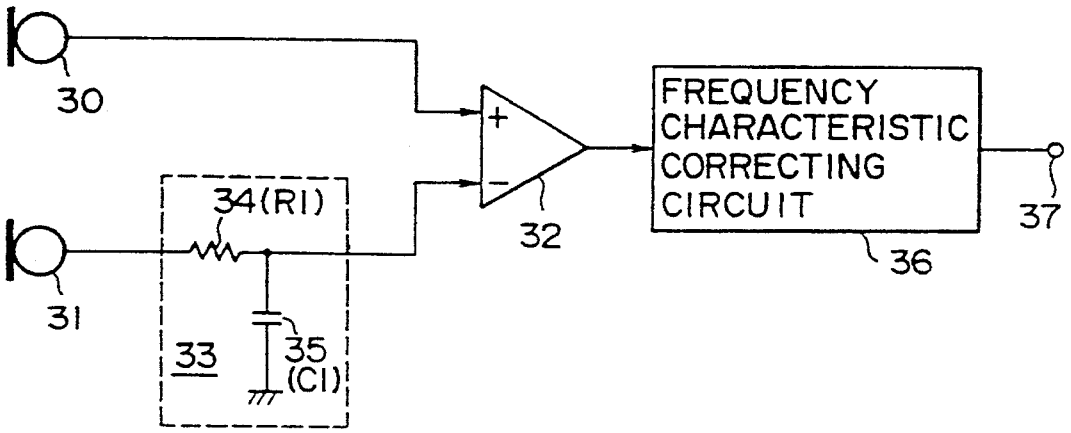
FIG. 9 is a diagram illustrating the example of constituting the microphone with a plurality of microphone units.

It should be noted that, in the example of FIG. 9, the filter 33, the subtracting circuit 32, and the frequency characteristic correcting circuit 36 may also be implemented by a digital filter or a program (software).

Figure 10:
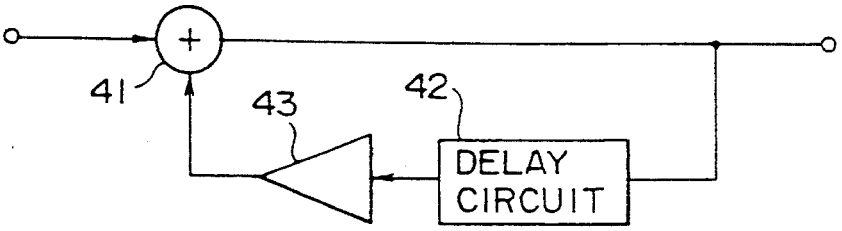
FIG. 10 is a diagram illustrating another example of a part of the constitution of FIG. 9.

For example, the filter 33 may be constituted by a digital filter comprising an adder 41, a delay circuit 42, and a transfer function A feedback amplifier 43 as shown in FIG. 10.

Although the microphone apparatus according to the present invention has been described as applied to the microphone unit for the camcorder, the present invention is also applicable to any microphone systems, including a stand-alone microphone unit, a microphone for a professional-use video camera, and an instrumentation microphone.

It should also be noted that, although, in the above-mentioned example, the adaptive filter circuit 24 is constituted by a digital circuit to make the entire system, digital, the filter circuit 24 may also be constituted by an analog circuit to make the entire system analog. It is also possible to make only the filter circuit 24 digital in an analog system.

Thus, according to the present invention, simply modifying the directional characteristics of the first and second microphones may implement a microphone system having desired directional characteristics. Further substituting the second microphone with a microphone having a different directional characteristic may change the directional characteristic of the entire microphone system, thus providing wide freedom in implementation of the directional characteristics. These features allow the embodiments to be used in a variety of applications, bringing about a remarkable practical effect.

Additionally, according to the present invention, the first and second microphones may be placed in proximity to each other and they need not be provided with a special shape such that of a gun microphone, thereby providing a compact, easy-to-transport implementation.

While preferred embodiments of the invention have been described using specific terms, such description is for illustrative purpose only, and it is to be understood that changes and variations may be made without departing from the spirit or scope of the appended claims.

What is claimed is:

1. A microphone apparatus comprising:

a first microphone for picking up at least a desired sound coming from an arrival direction;

a second microphone arranged in proximity to arid adjacent said first microphone and having a directionality in which said second microphone has a low sound-pickup sensitivity in said arrival direction of said desired sound wherein said second microphone comprises a plurality of non-directional microphone units axially aligned and placed in proximity to each other so as to be spaced apart by a predetermined distance, a filter receiving an output from one of said plurality of microphone units and wherein output sound signals of remaining ones of said plurality of nondirectional microphone units and an output of said filter are combined to provide an output representing a directional microphone;

adaptive filter means to which said output from said second microphone is supplied; and subtracting means for subtracting an output of said adaptive filter means from a signal picked up by said first microphone for producing an output signal of said microphone apparatus;

wherein said adaptive filter means is adjusted in response to the output signal of said subtracting means to minimize a power of the output signal of said subtracting means.

2. A microphone apparatus as defined in claim 1, wherein said adaptive filter means controls a filter weight to minimize the power of the output signal of said subtracting means.

3. A microphone apparatus comprising:

a first microphone having a first directionality;

a second microphone arranged in proximity to said first microphone and having a second directionality different than said first directionality of said first microphone, wherein said second microphone comprises a plurality of non-directional microphone units axially aligned and placed in proximity to each other so as to be spaced apart by a predetermined distance, a filter receiving an output from one of said plurality of microphone units and wherein output sound signals of remaining ones of said plurality of non-directional microphone units and an output of said filter are combined to provide an output representing a directional microphone;

adaptive filter means to which said output from said second microphone is supplied; and subtracting means for subtracting an output of said adaptive filter means from a signal picked up by said first microphone for producing an output signal of said microphone apparatus;

wherein said adaptive filter means is adjusted in response to the output signal of said subtracting means to minimize a power of the output signal of said subtracting means.

4. A microphone apparatus as defined in claim 3, wherein said adaptive filter means controls a filter weight to minimize the power of the output signal of said subtracting means.

5. A microphone apparatus used on a lightweight handheld television camera with an incorporated video cassette recorder comprising:

a first microphone having a first directionality for picking up at least a sound arriving from a direction in which a lens of said television camera is directed;

a second microphone arranged proximate and adjacent said first microphone and having a second directionality different than said first directionality of said first microphone and having a low sensitivity to a sound arriving from said direction, wherein said second microphone comprises a plurality of non-directional microphone units axially aligned and placed in proximity to each other so as to be spaced apart by a predetermined distance, a filter receiving an output from one of said plurality of microphone units and wherein output sound signals of remaining ones of said plurality of nondirectional microphone units and an output of said filter are combined to provide an output representing a directional microphone;

adaptive filter means to which said output from said second microphone is supplied; and subtracting means for subtracting an output of said adaptive filter means from a signal picked up by said first microphone for producing an output signal of said microphone apparatus;

wherein said adaptive filter means is adjusted by the output signal of said subtracting means to minimize a power of the output signal of said subtracting means.

6. A microphone apparatus as defined in claim 5, wherein said adaptive filter means controls a filter weight to minimize the power of the output signal of said subtracting means.

* * * * *

UNITED STATES PATENT AND TRADEMARK OFFICE

CERTIFICATE OF CORRECTION

PATENT NO. : 5,471,538

DATED : November 28, 1995

INVENTOR(S) : Tooru Sasaki
Kaoru Gyotoku

It is certified that error appears in the above-indentified patent and that said Letters Patent is hereby corrected as shown below:

Col. 1, line 22, delete "long"

Col. 2, line 48, after "another" delete "-"

Col. 4, line 49, change "$X_k 32[x_{0k} x_{1k} x_{21}$" to —$X_k = [x_{0k}\ x_{1k}\ x_{2k}$— line 51, change "an" to —as—

Col. 7, line 3, change "-" to —0— line 9, delete "-"

delete line 40- "and is configured to be Cl*Rl)"

Col. 8, line 18, after "such" insert —as—

In the claims:

Col. 8, line 29, change "arid" to —and— line 32, after "sound" insert —,—

Signed and Sealed this

Twentieth Day of May, 1997

*Attest:*

*Attesting Officer*

BRUCE LEHMAN

*Commissioner of Patents and Trademarks*